US012644379B2

(12) United States Patent
Feliu et al.

(10) Patent No.: US 12,644,379 B2
(45) Date of Patent: Jun. 2, 2026

(54) PRESSURE RESPONSE TEST TO DETECT LEAKAGE OF ROTATING CONTROL DEVICE

(71) Applicant: Schlumberger Technology Corporation, Sugar Land, TX (US)

(72) Inventors: Rodrigo Feliu, Sugar Land, TX (US); Christopher Scott Del Campo, Sugar Land, TX (US); Emilio De Matias Salces, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/117,651

(22) PCT Filed: Oct. 10, 2023

(86) PCT No.: PCT/US2023/034830
§ 371 (c)(1),
(2) Date: Apr. 2, 2025

(87) PCT Pub. No.: WO2024/081242
PCT Pub. Date: Apr. 18, 2024

(65) Prior Publication Data

US 2026/0009325 A1 Jan. 8, 2026

Related U.S. Application Data

(60) Provisional application No. 63/379,523, filed on Oct. 14, 2022.

(51) Int. Cl.
*E21B 47/117* (2012.01)
*E21B 34/02* (2006.01)

(52) U.S. Cl.
CPC ..... *E21B 47/117* (2020.05); *E21B 34/025* (2020.05)

(58) Field of Classification Search
CPC ..... E21B 21/08; E21B 21/082; E21B 21/085; E21B 21/10
See application file for complete search history.

(56) References Cited

U.S. PATENT DOCUMENTS 7,040,394 B2 5/2006 Bailey
7,487,837 B2 2/2009 Bailey
(Continued)

FOREIGN PATENT DOCUMENTS

WO 2014105077 A1 7/2014
WO 2015060836 A1 4/2015

OTHER PUBLICATIONS

International Search Report and Written Opinion of International Patent Application No. PCT/US2023/034830 dated on Feb. 7, 2024, 12 pages.

*Primary Examiner* — David Carroll
(74) *Attorney, Agent, or Firm* — Jeffrey D. Frantz

(57) ABSTRACT

A method includes initiating a managed pressure drilling (MPD) operation in an MPD system including a rotating control device (RCD) including at least one sealing element and a plurality of pressures sensors placed relative to the at least one scaling element. The RCD is positioned in the MPD system so as to receive fluid exiting an annulus of a wellbore. Further, the method includes creating a pressure spike in the annulus of the wellbore during the MPD operation, and monitoring a pressure differential between the plurality of pressure sensors to determine whether there is a leakage within the RCD.

20 Claims, 3 Drawing Sheets

(56) References Cited

U.S. PATENT DOCUMENTS

| | | | | |
|---|---|---|---|---|
| 7,743,823 | B2 | 6/2010 | Hughes | |
| 8,033,335 | B2 | 10/2011 | Orbell | |
| 8,347,983 | B2 | 1/2013 | Hoyer | |
| 8,636,087 | B2 | 1/2014 | Hannegan | |
| 9,371,697 | B2 | 6/2016 | Gray et al. | |
| 9,702,210 | B2 | 7/2017 | Dirksen | |
| 10,240,426 | B2 | 3/2019 | Grace | |
| 10,612,336 | B2 | 4/2020 | Lewis | |
| 10,781,657 | B2 | 9/2020 | Hardt | |
| 11,885,213 | B2 | 1/2024 | Mammadov | |
| 12,398,604 | B2 | 8/2025 | Katanguri | |
| 2009/0152006 | A1* | 6/2009 | Leduc | E21B 33/085 175/48 |
| 2010/0008190 | A1 | 1/2010 | Gray et al. | |
| 2010/0288507 | A1 | 11/2010 | Duhe et al. | |
| 2014/0299316 | A1 | 10/2014 | Needham et al. | |
| 2016/0168911 | A1 | 6/2016 | Karigan | |
| 2019/0078429 | A1* | 3/2019 | Zheng | H04W 4/00 |
| 2019/0093445 | A1 | 3/2019 | Kulkarni et al. | |
| 2020/0362651 | A1* | 11/2020 | Fraczek | F16J 15/06 |
| 2020/0362659 | A1* | 11/2020 | Fraczek | E21B 33/068 |
| 2022/0381105 | A1* | 12/2022 | Wilson | E21B 21/08 |

* cited by examiner

PRESSURE RESPONSE TEST TO DETECT LEAKAGE OF ROTATING CONTROL DEVICE

CROSS-REFERENCE TO RELATED APPLICATION

The present document is the National Stage Entry of International Application No. PCT/US2023/034830, filed Oct. 10, 2023, which is based on and claims priority to U.S. Provisional Patent Application No. 63/379,523, filed Oct. 14, 2022, which is incorporated herein by reference in its entirety.

BACKGROUND

Drilling systems are often employed to access natural resources below the surface of the earth. Such drilling systems may include a drilling fluid system configured to circulate drilling fluid into and out of a wellbore to facilitate drilling the wellbore. In some cases, the drilling system may use managed pressure drilling ("MPD"), which may require the well to be "capped" with a rotating control device ("RCD"). An RCD is used to contain and isolate pressure in the wellbore annulus while rotary drilling. The RCD contains a sealing element and a bearing assembly. The sealing element creates a seal against the drill string while drilling. The bearing assembly allows the sealing element to rotate with the drill string, eliminating relative rotation between the drill string and the sealing element.

Having an effective sealing element within the RCD is imperative for proper MPD operations. Unfortunately, an RCD sealing element may fail during MPD operations, jeopardizing the operation. Accordingly, there is a need for a way to test the effectiveness of an RCD sealing element in situ and during MPD operations.

SUMMARY

According to one or more embodiments of the present disclosure, a method includes: initiating a managed pressure drilling operation in a managed pressure drilling system including: a rotating control device including: at least one sealing element; and a plurality of pressure sensors placed relative to the at least one sealing element, wherein the rotating control device is positioned in the managed pressure drilling system so as to receive fluid exiting an annulus of a wellbore; creating a pressure spike in the annulus of the wellbore during the managed pressure drilling operation; and monitoring a pressure differential between the plurality of pressure sensors to determine whether there is a leakage within the rotating control device.

According to one or more embodiments of the present disclosure, a test system for a managed pressure drilling system includes: a rotating control device including: at least one sealing element; and a plurality of pressure sensors placed relative to the at least one sealing element, wherein the rotating control device is positioned in the managed pressure drilling system so as to receive fluid exiting an annulus of a wellbore; a pump; and a choke manifold connected to the rotating control device via a primary line, wherein at least one of the pump and the choke manifold is configured to create a pressure spike in the annulus of the wellbore during a managed pressure drilling operation.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
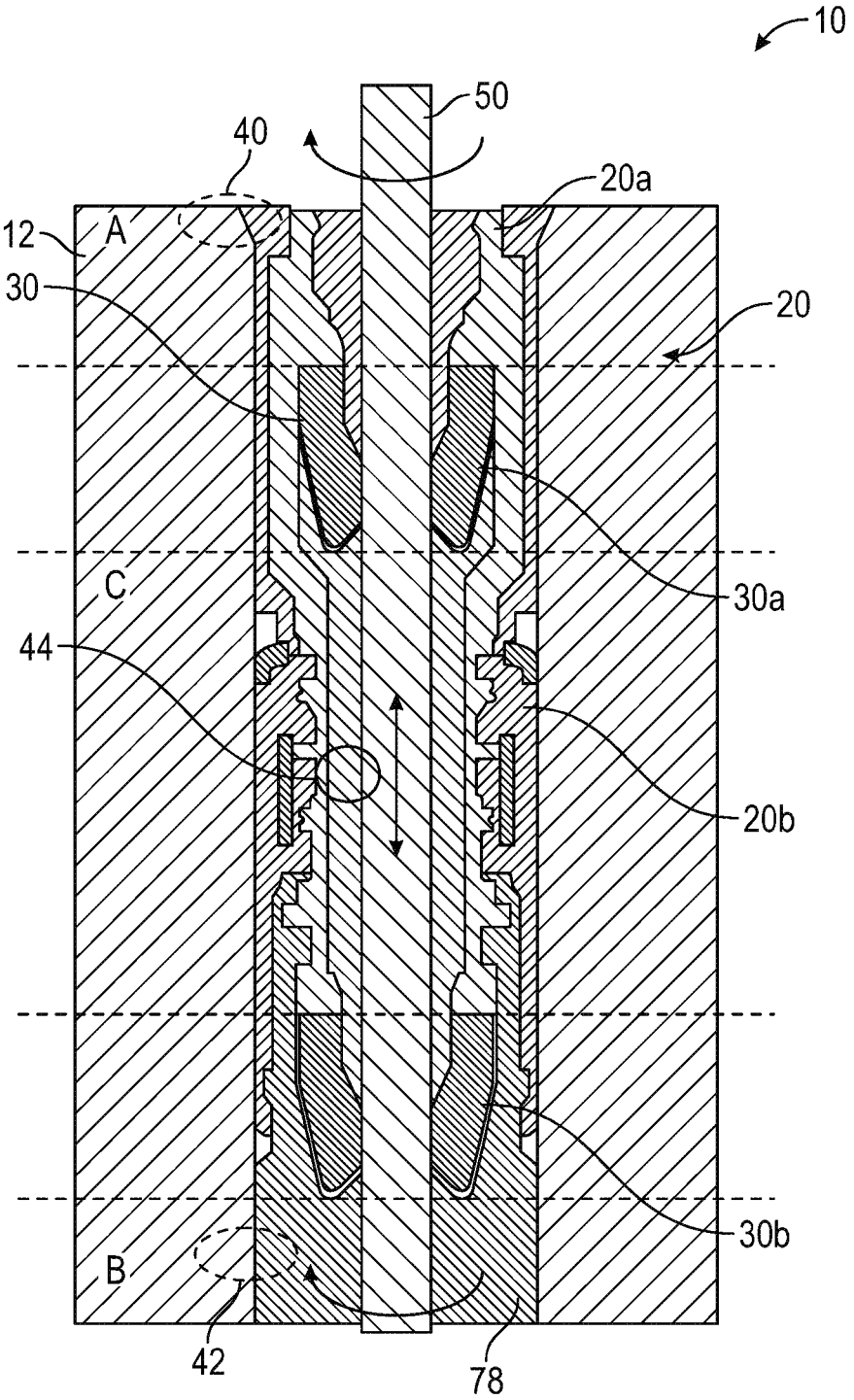
FIG. 1 shows an example of an RCD used in systems and methods according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," "up," "down," "upper," "lower," and variations of these terms is made for convenience, but does not require any particular orientation of the components relative to some fixed reference, such as the direction of gravity. The terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "fluid" encompasses liquids, gases, vapors, and combinations thereof. Any references to "metal" include metal alloys.

In general, embodiments of the present disclosure relate to MPD operations. More specifically, embodiments of the present disclosure relate to testing the effectiveness and condition monitoring of an RCD component during MPD operations. Condition monitoring is a process of monitoring equipment condition indicators for changes to identify future faults, failures, breakdowns, and other maintenance problems associated with equipment. Condition monitoring is increasingly utilized in the oil and gas industry as part of predictive maintenance of wellsite (e.g., drilling) equipment. Condition monitoring utilizes condition data generated by peripheral (e.g., add-on) sensors and instruments to gain more insight to future maintenance problems. Condition data, such as pressure data, vibration data, acoustic data, thermographic (e.g., infrared signature) data, is used solely to indicate condition of equipment. Condition monitoring also includes analyzing operational data to determine an amount of equipment usage and compare the determined equipment usage to expected operational lifetime specifications and/or calculations. According to one or more embodiments of the present disclosure, condition monitoring may be used determine the integrity of an RCD component, such as the sealing element, for example. Condition monitoring may also be used to track degradation of the RCD component, for example. With respect to condition monitoring, this disclosure is related to U.S. Patent Application Publication No. 2020/0291767, entitled "PERFORMANCE BASED CONDITION MONITORING," the disclosure of which is incorporated herein by reference in its entirety.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore, i.e., the wellbore annulus.

As also set forth above, the drilling system may use MPD in some cases. MPD regulates a pressure and a flow of the drilling fluid within the drill string so that the flow of the drilling fluid does not over-pressurize a well (e.g., expand the well) and/or blocks the well from collapsing under its own weight. The ability to manage the pressure and the flow of the drilling fluid enables use of the drilling system to drill in various locations, such as locations with relatively softer seabeds.

The drilling system according to one or more embodiments of the present disclosure may include one or more RCDs. Each RCD is configured to form a seal across and/or to block fluid flow through the annular space that surrounds the drill string. For example, the RCD may be configured to block the drilling fluid, cuttings, and/or natural resources (e.g., carbon dioxide, hydrogen sulfide) from passing across the RCD from the well toward the platform. In some embodiments, the fluid flow may be diverted toward another suitable location (e.g., a collection tank) other than the platform.

Referring now to FIG. 1, an RCD 10 according to one or more embodiments of the present disclosure is shown. The RCD 10 includes a bearing package 20, at least one sealing element 30, and an RCD housing 12. The bearing package 20 and the at least one sealing element 30, which is configured to grip around a drill string 50, enable rotation and longitudinal motion of the drill string 50 as the wellbore is drilled, while maintaining a fluid-tight seal between the drill string 50 and the wellbore so that drilling fluid discharged from the wellbore may be discharged in a controlled manner. By controlling discharge of the fluid from the wellbore, a selected fluid pressure may be maintained in the annular space between the drill string and an exterior of the wellbore.

As shown in FIG. 1, the bearing package 20 of the RCD 10 according to one or more embodiments of the present disclosure may include a rotating component 20*a* and a stationary component 20*b*. As further shown in FIG. 1, the at least one sealing element 30 of the RCD 10 according to one or more embodiments of the present disclosure may include an upper sealing element 30*a* and a lower sealing element 30*b* disposed around the drill string 50. While FIG. 1 shows the RCD 10 having two sealing elements 30*a*, 30*b*, an RCD having a single sealing element 30 is contemplated and within the scope of the present disclosure.

Still referring to FIG. 1, the bearing package 20 of the RCD 10 allows the at least one sealing element 30 to rotate along with the drill string 50, according to one or more embodiments of the present disclosure. Therefore, in using the RCD 10, there is no relative movement between the at least one sealing element 30 and the drill string 50. Only the rotating component 20*a* of the bearing package 20 exhibits relative rotational movement according to one or more embodiments of the present disclosure.

Still referring to FIG. 1, the RCD 10 according to one or more embodiments of the present disclosure includes a first pressure sensor 40 placed above the at least one sealing element 30, and a second pressure sensor 42 placed below the at least one sealing element 30. As shown in FIG. 1, for example, the first pressure sensor 40 may be placed above the upper sealing element 30*a* and the second pressure sensor 42 may be placed below the lower sealing element 30*b*, according to one or more embodiments of the present disclosure. As also shown in FIG. 1, at least one intermediate pressure sensor 44 may be placed between the upper sealing element 30*a* and the lower sealing element 30*b* without departing from the scope of the present disclosure. Placement of pressure sensors in the RCD 10 in this way creates a plurality of pressure sensor zones including pressure sensor zone A, which includes first pressure sensor 40 above all seals 30*a*, 30*b*, pressure sensor zone B, which includes second pressure sensor 42 below all seals 30*a*, 30*b*, and pressure sensor zone C, which includes intermediate pressure sensor 44 between upper sealing element 30*a* and lower sealing element 30*b*, as shown in FIG. 1, for example. In addition to the pressure sensors shown in FIG. 1, any of pressure sensor zones A, B, and C may include redundant pressure sensors in the case of a sensor failure or error, according to one or more embodiments of the present disclosure. Moreover, while only pressure sensor zone C is shown as an intermediate pressure sensor zone including intermediate pressure sensor 44, any number of intermediate pressure sensor zones for intermediate pressure sensors 44 is possible and contemplated as being within the scope of the present disclosure. Further, while FIG. 1 only shows two sealing elements 30*a*, 30*b* as an example, the RCD 10 according to one or more embodiments of the present disclosure may include any number of sealing elements without departing from the scope of the present disclosure.

Figure 2:
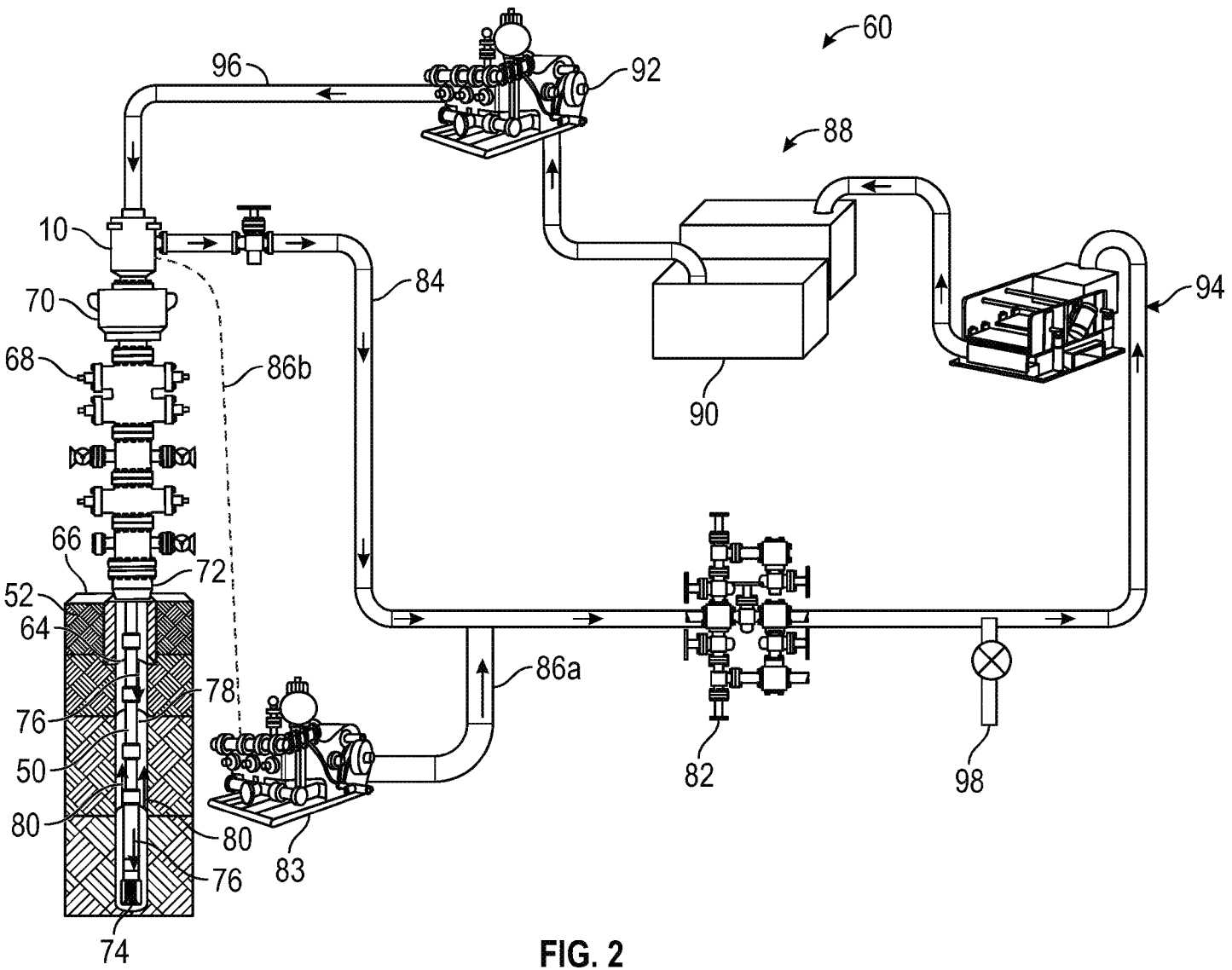
FIG. 2 shows a managed pressure drilling system according to one or more embodiments of the present disclosure.

As previously described, the RCD 10 according to one or more embodiments of the present disclosure may be a component of an MPD system 60, such as that shown in FIG. 2, for example. The MPD system 60 is shown in relation to a wellbore 64 formed by rotary and/or directional drilling from a wellsite surface 66 and extending into a subterranean formation 52. A drill string 50 having a drill bit 74 on a downhole end thereof may be suspended in the wellbore 64. Rotation of the drill bit 74 and the weight of the drill string 50 collectively operate to form the wellbore 64. According to one or more embodiments of the present disclosure, the drill string 50 may be conveyed within the wellbore 64 through various fluid control devices disposed at the wellsite surface 66 on top of the wellbore 64. The fluid control devices may be operable to control fluid within the wellbore 64. The fluid control devices may include a blowout preventer (BOP) stack 68 for maintaining well pressure control including a series of pressure barriers (e.g., rams) between the wellbore 64 and the wellsite surface 66 and an annular BOP 70. The fluid control devices may also include the RCD 10 mounted above the annular BOP 70. While FIG. 2 shows the RCD 10 mounted above the annular BOP 70, the RCD 10 may also be mounted on top of a riser as understood by those having ordinary skill in the art without departing from the scope of the present disclosure. According to one or more embodiments of the present disclosure, the BOP stack 68, annular BOP 70, and RCD 10 may be mounted on top of a wellhead 72. During drilling operations, drilling fluid may flow downhole through an internal passage of the drill string 50, as indicated by directional arrows 76. The drilling fluid may exit the drill bit 74 via ports in the drill bit 74 and then circulate uphole though an annular space 78 ("annulus") of the wellbore 64 defined between an exterior of the drill string 50 and a wall of the wellbore 64, such flow being indicated by directional arrows 80. In this manner, the drilling fluid lubricates the drill bit 74 and carries formation cuttings uphole to the wellsite surface 66. The returning drilling fluid may exit the annulus 78 via the RCD 10 or other fluid control devices during different phases or scenarios of managed pressure drilling operations. For additional clarity, the annulus 78 is shown in FIG. 1 with respect to the RCD 10. As such, the RCD 10 is positioned in the MPD system 60 so as to receive fluid exiting the annulus 78 of the wellbore 64, according to one or more embodiments of the present disclosure.

Still referring to FIG. 2, the MPD system 60 includes an MPD choke manifold 82 connected to the RCD 10 via a primary line 84, according to one or more embodiments of the present disclosure. The MPD system 60 according to one or more embodiments of the present disclosure may also include a backpressure pump 83 having an inlet and an outlet. The inlet of the backpressure pump 83 may be connected to a fluid source, such as a tank 90 of a drilling fluid circulation system 88 as further described below, and the outlet of the backpressure pump 83 may be connected to a backpressure line 86*a*, which is fluidly connected to the RCD 10 via the primary line 84. According to one or more embodiments of the present disclosure, the backpressure line 86*a* is connected to the primary line 84 at a location upstream of the choke manifold 82. Alternatively, the backpressure line 86*b* is a dedicated test line that is connected directly to the RCD 10, according to one or more embodiments of the present disclosure.

Still referring to FIG. 2, the MPD system 60 according to one or more embodiments of the present disclosure is connected to a drilling fluid circulation system 88. According to one or more embodiments of the present disclosure, the drilling fluid circulation system 88 includes at least one tank 90 containing drilling fluid, at least one drilling fluid pump 92, and drilling fluid reconditioning equipment 94. According to one or more embodiments of the present disclosure, the at least one drilling fluid pump 92 is operable to move the drilling fluid from the at least one tank 90 and into a fluid passage of the drill string 50 disposed in the wellbore 64 via a fluid conduit 96 disposed between the at least one drilling fluid pump 92 and the RCD 10. According to one or more embodiments of the present disclosure, the drilling fluid reconditioning equipment 94 is located downstream of the choke manifold 82 of the MPD system 60. According to one or more embodiments of the present disclosure, the drilling fluid reconditioning equipment 94 cleans or reconditions the drilling fluid before returning the drilling fluid to the at least one tank 90. The drilling fluid reconditioning equipment 94 may include one or more shakers for separating and removing solid particles (e.g., drill cuttings) from the drilling fluid, for example. In addition to one or more shakers, drilling fluid reconditioning equipment 94 may include a degasser, a desander, a desilter, a centrifuge, a mud cleaner, and/or a decanter, among other examples.

During managed pressure drilling operations, the drilling fluid may exit the annulus 78 of the wellbore 64 via the RCD 10 and then be directed into the MPD choke manifold 82 via the primary line 84 of the MPD system 60. According to one or more embodiments of the present disclosure, the choke manifold 82 may include at least one choke and a plurality of fluid valves collectively operable to control the flow through and out of the choke manifold 82. According to one or more embodiments of the present disclosure, backpressure may be applied to the annulus 78 by variably restricting flow of the drilling fluid or other fluids flowing through the choke manifold 82. The greater the restriction to flow through the choke manifold 82, the greater the backpressure applied to the annulus 78. The drilling fluid exiting the choke manifold 82 may then pass through the drilling fluid reconditioning equipment 94 before being returned to the tank 90 for recirculation. As further shown in FIG. 2, drilling fluid exiting the choke manifold 82 may be alternatively routed to a mud gas separator (i.e., rig's poor boy) 98 for removal of formation gasses entrained in the drilling fluid discharged from the wellbore 64.

Figure 3:
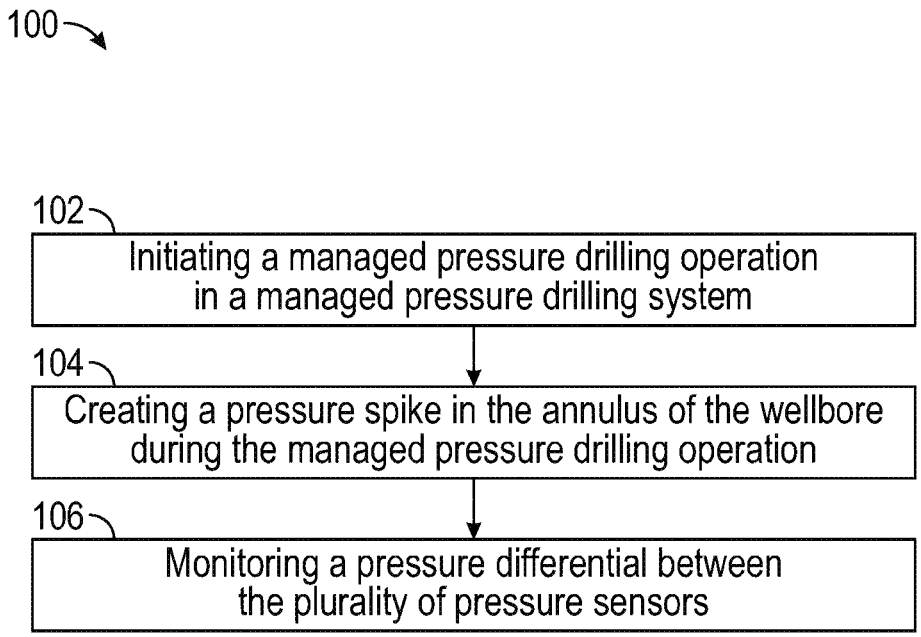
FIG. 3 shows a method according to one or more embodiments of the present disclosure.

Referring now to FIG. 3, in a method 100 according to one or more embodiments of the present disclosure, the at least one sealing element 30 of the RCD 10 may be tested during an MPD operation to determine the integrity of the at least one sealing element 30. As shown in step 102 of the method 100 according to one or more embodiments of the present disclosure, an MPD operation may be initiated in an MPD system 60, such as that previously described in view of FIG. 2, for example. As shown in step 104 of the method 100 according to one or more embodiments of the present disclosure, a pressure spike may be created in the annulus 78 of the wellbore 64 during the MPD operation. According to one or more embodiments of the present disclosure, a pump connected to the RCD 10 creates the pressure spike in the annulus 78 of the wellbore 64 during the MPD operation. More specifically, the pump is configured to direct fluid into a test port (not shown) of the RCD 10 to create the pressure spike in the annulus 78 of the wellbore 64 during the MPD operation, according to one or more embodiments of the present disclosure. According to one or more embodiments of the present disclosure, the pump connected to the RCD 10 that creates the pressure spike in the annulus 78 of the wellbore 64 is the backpressure pump 83, as previously described. In such embodiments, creating the pressure spike in the annulus 78 of the wellbore 64 during the MPD operation includes pumping a backpressure fluid into the backpressure line 86*a*, 86*b*, which is fluidly connected to the RCD 10, either via the primary line 84 at a location upstream of the choke manifold 82 (86*a*), or via a dedicated test line that is connected directly to the test port of the RCD 10 (86*b*). Alternatively, the pump that creates the pressure spike in the annulus 78 of the wellbore 64 may be a different pump (other than the backpressure pump 83) connected to the RCD 10, according to one or more embodiments of the present disclosure. Instead of utilizing a pump connected to the RCD 10, the pressure spike in the annulus 78 of the wellbore 64 may be created by restricting a flow of the fluid flowing through the MPD choke manifold 82, according to one or more embodiments of the present disclosure. As previously described, restricting the flow of the fluid flowing through the MPD choke manifold 82 may apply backpressure to the annulus 78 of the wellbore 64, thereby creating the pressure spike in the annulus 78, according to one or more embodiments of the present disclosure.

Still referring to FIG. 3, after creating the pressure spike in the annulus 78 of the wellbore 64, a plurality of pressure sensors placed relative to the at least one sealing element 30 is monitored in the method 100 according to one or more embodiments of the present disclosure. As previously described, the plurality of pressure sensors may include the first pressure sensor 40 placed above the at least one sealing element 30, the second pressure sensor 42 placed below the at least one sealing element 30, and the intermediate pressure sensor 44 placed between the upper sealing element 30*a* and the lower sealing element 30*b*, creating different pressure sensor zones, according to one or more embodiments of the present disclosure. As also previously described, any of the pressure sensor zones may include redundant pressure sensors without departing from the scope of the present disclosure.

Condition monitoring techniques such as those previously described may be used to monitor the first pressure sensor 40, the second pressure sensor 42, and the intermediate pressure sensor 44, according to one or more embodiments of the present disclosure. More specifically, the first pressure sensor 40, the second pressure sensor 42, and the intermediate pressure sensor 44 are configured to generate pressure sensor data indicative of a condition of the at least one sealing element 30 as a result of creating the pressure spike in the annulus 78 of the wellbore 64 during the MPD operation. For example, a pressure differential between the plurality of pressure sensors may be monitored, as shown in step 106 of the method 100 according to one or more embodiments of the present disclosure.

Referring back to FIG. 1, in an example where the first pressure sensor 40 is placed in pressure sensor zone A above the at least one sealing element 30, and the second pressure sensor 42 is placed in pressure sensor zone B below the at least one sealing element 30, if the integrity of the at least one sealing element 30 has not been compromised, then the pressure spike in the annulus 78 should be detected by the second pressure sensor 42 placed in pressure sensor zone B, and the pressure spike should not be detected by the first pressure sensor 40 placed in pressure sensor zone A. In this example, if the pressure spike is detected by the first pressure sensor 40 placed in pressure sensor zone A, then the integrity of the at least one sealing element 30 may have been compromised, and there may be a leak through the bearing package 20 of the RCD 10.

Still referring back to FIG. 1, in another example where the first pressure sensor 40 is placed in pressure sensor zone A above the upper and lower sealing elements 30*a*, 30*b*, the second pressure sensor 42 is placed in pressure sensor zone B below the upper and lower sealing elements 30*a*, 30*b*, and the intermediate pressure sensor 44 is placed in pressure sensor zone C between the upper and lower sealing elements 30*a*, 30*b*, if the second pressure sensor 42 and the intermediate pressure sensor 44 generate substantially similar pressure sensor data as a result of the pressure spike in the annulus 78, but the first pressure sensor 40 generates pressure sensor data that differs from that generated by the second pressure sensor 42 and the intermediate pressure sensor 44, then the lower sealing element 30*b* is likely damaged, and the upper sealing element 30*a* is likely working properly. Alternatively, if the second pressure sensor 42 and the intermediate pressure sensor 44 generate different pressure sensor data as a result of the pressure spike in the annulus 78, then the lower sealing element 30*b* is likely working properly, and the integrity of the upper sealing element 30*a* is unclear.

In any of the above examples, the shape of the pressure spike (i.e., how fast the pressure spike rises compared to the measurement below) would indicate the magnitude of the leak within the RCD 10. According to one or more embodiments of the present disclosure, it may be determined that the integrity of the at least one sealing element 30 has been compromised when the pressure differential between the plurality of pressures sensors exceeds a predetermined threshold. If the integrity of the at least one sealing element 30 has indeed been comprised, the method according to one or more embodiments of the present disclosure may include replacing the at least one sealing element 30 or other component of the RCD 10.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A method, comprising:

initiating a managed pressure drilling operation in a managed pressure drilling system comprising:

a rotating control device comprising:

at least one sealing element; and a plurality of pressure sensors placed relative to the at least one sealing element, wherein the rotating control device is positioned in the managed pressure drilling system so as to receive fluid exiting an annulus of a wellbore;

creating a pressure spike in the annulus of the wellbore during the managed pressure drilling operation; and monitoring a pressure differential between the plurality of pressure sensors to determine whether there is a leakage within the rotating control device, wherein the managed pressure drilling system further comprises:

a choke manifold connected to the rotating control device via a primary line; and a backpressure pump having an inlet and an outlet, wherein the inlet of the backpressure pump is connected to a fluid source, wherein the outlet of the backpressure pump is connected to a backpressure line, wherein the backpressure line is fluidly connected to the rotating control device, and wherein the backpressure line is a dedicated test line that is connected directly to the rotating control device.

2. The method of claim 1, further comprising replacing the at least one sealing element when the pressure differential between the plurality of pressure sensors exceeds a predetermined threshold.

3. The method of claim 1, wherein the plurality of pressure sensors comprises: a first pressure sensor placed above the at least one sealing element, and a second pressure sensor placed below the at least one sealing element.

4. The method of claim 1, wherein the at least one sealing element comprises: an upper sealing element; and a lower sealing element, wherein the plurality of pressure sensors comprises: a first pressure sensor placed above the upper and lower sealing elements; a second pressure sensor placed below the upper and lower sealing elements; and an intermediate pressure sensor placed between the upper and lower sealing elements.

5. The method of claim 1, wherein a pump connected to the rotating control device creates the pressure spike in the annulus of the wellbore during the managed pressure drilling operation.

6. The method of claim 1, wherein creating the pressure spike in the annulus of the wellbore during the managed pressure drilling operation comprises restricting a flow of the fluid flowing through the choke manifold.

7. The method of claim 1, wherein creating the pressure spike in the annulus of the wellbore during the managed pressure drilling operation comprises pumping a backpressure fluid into the backpressure line using the backpressure pump.

8. The method of claim 1, wherein the managed pressure drilling system is connected to a drilling fluid circulation system comprising:

at least one tank containing drilling fluid;

at least one drilling fluid pump operable to move the drilling fluid from the at least one tank and into a fluid passage of a drill string disposed in the wellbore via a fluid conduit disposed between the at least one drilling fluid pump and the rotating control device; and drilling fluid reconditioning equipment located downstream of the choke manifold that cleans or reconditions the drilling fluid before returning the drilling fluid to the tank.

9. The method of claim 8, wherein the drilling fluid reconditioning equipment comprises a shaker.

10. The method of claim 8, wherein the fluid source connected to the inlet of the backpressure pump is the at least one tank.

11. The method of claim 1, wherein the rotating control device is placed on top of a blowout preventer stack in the managed pressure drilling system.

12. A test system for a managed pressure drilling system comprising:

a rotating control device comprising:

at least one sealing element;

a plurality of pressure sensors placed relative to the at least one sealing element, wherein the rotating control device is positioned in the managed pressure drilling system so as to receive fluid exiting an annulus of a wellbore; and a test port;

a pump; and a choke manifold connected to the rotating control device via a primary line, wherein at least one of the pump and the choke manifold is configured to create a pressure spike in the annulus of the wellbore during a managed pressure drilling operation, wherein the plurality of pressure sensors are configured to generate pressure sensor data indicative of a condition of the at least one sealing element as a result of creating the pressure spike in the annulus of the wellbore during the managed pressure drilling operation, and wherein the pump is configured to direct fluid into the test port of the rotating control device to create the pressure spike in the annulus of the wellbore during the managed pressure drilling operation.

13. The test system of claim 12, wherein the plurality of pressure sensors comprises: a first pressure sensor placed above the at least one sealing element, and a second pressure sensor placed below the at least one sealing element.

14. The test system of claim 12, wherein the at least one sealing element comprises: an upper sealing element; and a lower sealing element, wherein the plurality of pressure sensors comprises: a first pressure sensor placed above the upper and lower sealing elements; a second pressure sensor placed below the upper and lower sealing elements; and an intermediate pressure sensor placed between the upper and lower sealing elements.

15. The test system of claim 12, wherein the pump is a backpressure pump having an inlet and an outlet, wherein the inlet of the backpressure pump is connected to a fluid source, and wherein the outlet of the backpressure pump is connected to a backpressure line, and wherein the backpressure line is fluidly connected to the rotating control device.

16. The test system of claim 15, wherein the backpressure line is connected to the primary line at a location upstream of the choke manifold.

17. The test system of claim 15, further comprising:

a drilling fluid circulation system comprising:

at least one tank containing drilling fluid;

at least one drilling fluid pump operable to move the drilling fluid from the at least one tank and into a fluid passage of a drill string disposed in the wellbore via a fluid conduit disposed between the at least one drilling fluid pump and the rotating control device; and drilling fluid reconditioning equipment located downstream of the choke manifold that cleans or reconditions the drilling fluid before returning the drilling fluid to the tank.

18. The test system of claim 17, wherein the fluid source connected to the inlet of the backpressure pump is the at least one tank.

19. The test system of claim 12, wherein the rotating control device is placed on top of a blowout preventer stack in the managed pressure drilling system.

20. A test system for a managed pressure drilling system comprising:

a rotating control device comprising:

at least one sealing element;

a plurality of pressure sensors placed relative to the at least one sealing element, wherein the rotating control device is positioned in the managed pressure drilling system so as to receive fluid exiting an annulus of a wellbore; and a test port;

a pump; and a choke manifold connected to the rotating control device via a primary line, wherein at least one of the pump and the choke manifold is configured to create a pressure spike in the annulus of the wellbore during a managed pressure drilling operation, wherein the plurality of pressure sensors are configured to generate pressure sensor data indicative of a condition of the at least one sealing element as a result of creating the pressure spike in the annulus of the wellbore during the managed pressure drilling operation, and wherein the pump is a backpressure pump having an inlet and an outlet, wherein the inlet of the backpressure pump is connected to a fluid source, and wherein the outlet of the backpressure pump is connected to a backpressure line, and wherein the backpressure line is fluidly connected to the rotating control device, and wherein the backpressure line is fluidly connected to the rotating control device via the test port.

* * * * *